United States Patent [19]

Bettencourt et al.

[11] 4,324,064

[45] Apr. 13, 1982

[54] TOY AIRCRAFT

[75] Inventors: Pierre A. Bettencourt; Charles H. Cleveland, both of Bend, Oreg.

[73] Assignee: North Pacific Products, Inc., Bend, Oreg.

[21] Appl. No.: 206,364

[22] Filed: Nov. 13, 1980

[51] Int. Cl.[3] ..... A63H 27/14

[52] U.S. Cl. ..... 46/81; 46/80

[58] Field of Search ..... 46/80, 81, 79, 76 R, 46/74

[56] References Cited

U.S. PATENT DOCUMENTS 1,599,280 9/1926 Lewis ..... 46/80
1,974,656 9/1934 Nelson ..... 46/80
3,222,817 12/1965 Brandstetter ..... 46/80
3,943,657 3/1976 Leckie ..... 46/80

FOREIGN PATENT DOCUMENTS 458228 7/1950 Italy ..... 46/80

*Primary Examiner*—Robert Peshock
*Assistant Examiner*—Mickey Yu

[57] ABSTRACT

A toy aircraft having a fuselage split into two halves which carry wings and are hinged together for movement from a launching position where a hook on one half projects for launching purposes, to a flight position where the hook blends into the other parts of the aircraft.

10 Claims, 7 Drawing Figures

TOY AIRCRAFT

The present invention relates to a toy aircraft and particularly a foldable wing type adapted to be launched in folded condition and then to open to an unfolded flight condition.

BACKGROUND OF THE INVENTION

Previously, there have been folding toy aircraft, but they have been complicated and thus expensive, or complicated and thus too heavy for ideal flight characteristics. Some have had flexible non-form sustaining wing material to be pleated or otherwise interfolded and subsequently movable to a spread flying position. They do not have the flight characteristics of aircraft in which the wing material is rigid, or at least sufficiently rigid as to be form-sustaining.

SUMMARY OF THE INVENTION

The present invention provides a toy aircraft having a fuselage split into two halves which carry wings and are hinged together for movement from a launching position, where a hook on one half projects for launching purposes, to a second stage flight position where the hook blends into the wing panels.

A main object of the invention is to provide an improved folding wing toy aircraft having wings of form-sustaining material.

Another object is to provide such a toy aircraft having a novel launching element.

The invention will be explained in connection with a toy glider but the concept could be incorporated in toy aircraft of other types.

The subject matter which we regard as our invention is particularly pointed out and distinctly claimed in the concluding portion of this specification. The invention, however, both as to organization and method of operation, together with further advantages and objects thereof, may be best understood by reference to the following description, taken in connection with the following drawings, wherein like reference characters refer to like elements.

Figure 1:
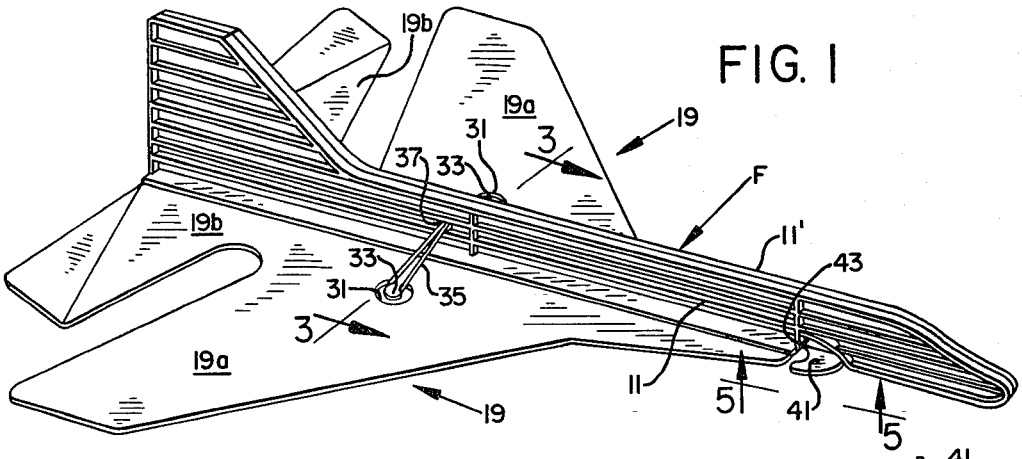
FIG. 1 is a perspective view of a toy glider of the present invention in its spread post-launching flight condition.

FIG. 1 shows a toy glider embodying the concepts of the present invention in its post-launching flight position. It comprises a fuselage F split into two essentially flat body halves or sections 11 and 11' which are of substantially identical form, differing only in a respect to be pointed out hereinafter. The two body halves are hingedly connected together at their lower edges by a strip of strong plastic adhesive tape 13, such as Mylar tape.

Preferably the body halves are injection molded of relatively rigid but light plastic material, and are formed in thin wall fashion and provided with ribs 15 (FIG. 3) for strength purposes. A lower pair of ribs 17 for each body half provides a slot for clamping engagement with the inner margin of an airfoil panel 19 for each half section. The panels are formed, in the particular form of the invention shown, to simulate an F-16 fighter aircraft, but could assume other forms. In the form shown, each airfoil panel includes a swept back wing section or panel **19*a* and a horizontal tail section 19*b*. Note that each fuselage section provides a vertical tail section 11*a***.

The airfoil panels are preferably formed of a light weight material, such as pressed foam plastic so as to be form-sustaining. Each is formed with a generally crescent shaped slot 31 which provides a knob 33. An endless elastic band 35 passes through holes 37 in the body halves 11 and 11' and hooks at opposite end portions over the knobs 33. The band applies a biasing force tending to hold the body halves 11 and 11' in side by side and face to face contact.

Body half 11' is formed with a hook 41 which is disposed at right angles to the plane of its body half and thus projects away from such plane. In the condition of the parts in FIG. 1, it projects under a recess 43 formed in body half 11. Note that in FIG. 1, the hook 41 is disposed in the plane of the associated flight panel and is accommodated by the recess.

Figure 3:
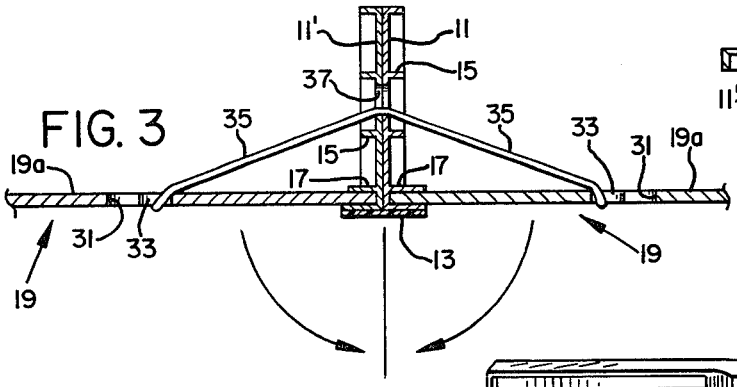
FIG. 3 is a fragmentary cross sectional view taken along line 3—3 of FIG. 1.
Figure 4:
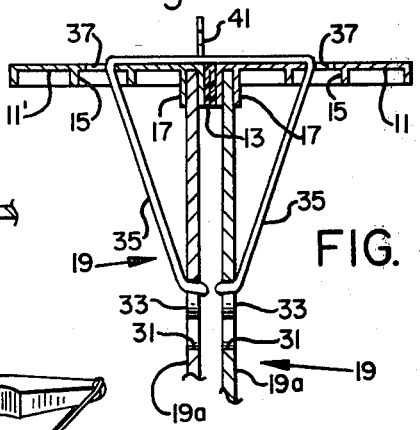
FIG. 4 is like FIG. 3 but showing the folded launching position of the parts.
Figure 7:
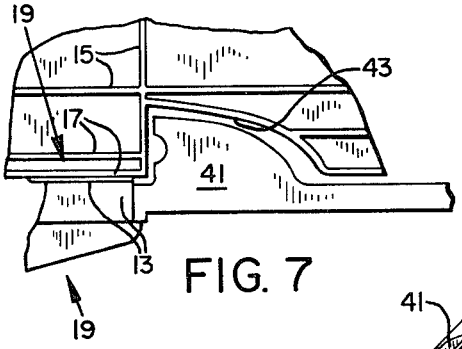
FIG. 7 is a fragmentary view showing the hook with the body halves at right angles to one another.

When a folding pressure is applied to the airfoil panels in the direction of the arrows in FIG. 3, the toy aircraft can be folded to where the airfoil panels are parallel to one another in spaced side by side relationship. In this condition, the biasing pressure applied by the rubber band 35 is less than at 45° from the FIG. 4 position, because the parts are approaching an almost overcenter position. Nevertheless, there is a sufficient biasing force to move the airfoil panels back to the FIG. 1 position, but insufficient force to do this rapidly.

Figure 2:
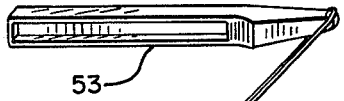
FIG. 2 is a perspective view of the glider in its folded launching position.
Figure 2:
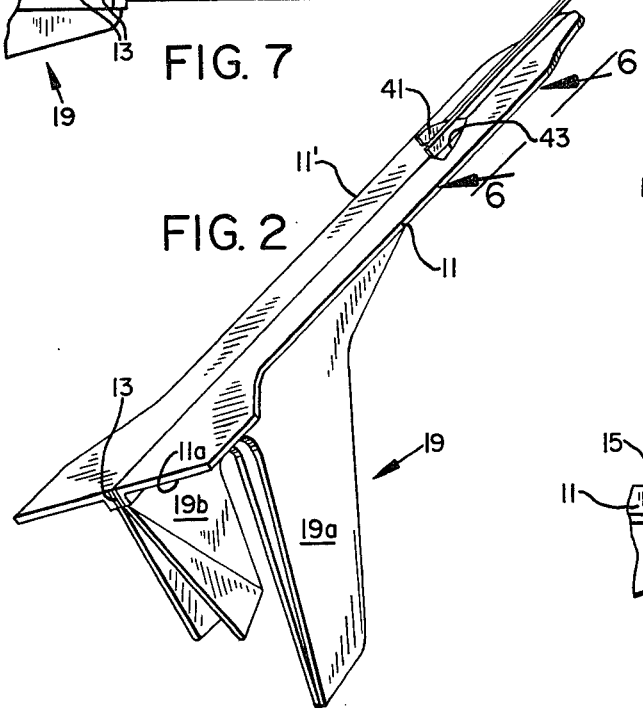
Figure 5:
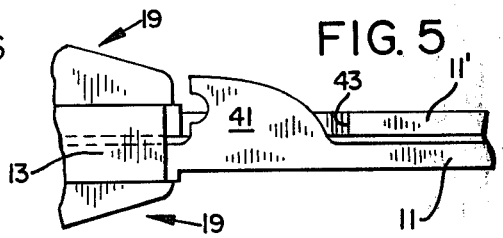
FIG. 5 is a fragmentary bottom elevational view of the toy aircraft taken in the direction of arrow 5—5 of FIG. 1.
Figure 6:
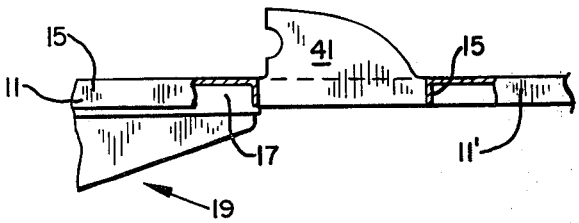
FIG. 6 is a view like FIG. 5 but showing the position of the launching element after the toy aircraft has been folded to its launching position.

Thus, when the aircraft is folded to its launching position as shown in FIG. 2, the hook 41 which was in a somewhat concealed planar position with the wing sections now projects by itself from the bottom plane of the opened up fuselage or body halves to be exposed to receive a launching band 51 of a launcher element 53 to enable the aircraft to be launched upon release of the aircraft after appropriately tensioning the elastic band 51.

What happens is that the aircraft tends to maintain the FIG. 2 position in its rapid upward flight until it slows down near the apex of its flight, whereupon the wings open up to the FIG. 1 position, wherein the aircraft has ideal flight characteristics for slower speed flight.

It is important to note that the biasing force exerted by the rubber band 35, which tends to pivot the aircraft from its launching position to its flight position, depends upon (1) the strength of the band itself, (2) how far the band is stretched, and (3) the angle at which the band operates. The distance the band is stretched depends only upon the spacing of the holes 37 from the hinge axis. The operational angle is very slight, being determined primarily by the thickness of the band, and thus being only a few degrees. The force tending to open up the aircraft from its launching condition is slight, since the band is almost in a toggle position and the force is thus considerably less than when the operative angle is greater.

We have discovered that a standard size rubber band, such as a B. F. Goodrich No. 16, will function satisfactorily provided certain conditions are met. The No. 16 band has a thickness of 1/16th inch × 1/32nd inch. The larger 1/16th inch dimension can be considered as width and the 1/32nd inch dimension as the thickness. However, on the 1/16th inch dimension, this can vary 1/32nd inch. Thus for a successful run of gliders, a specially made batch 3/64ths inch wide (which is within the tolerance of the No. 16 band) proved satisfactory. However, even these had to be graded because apparently there is no ready way of slicing rubber with a great deal of accuracy.

We have discovered that for the above standard band, (conforming closely to 3/64ths inch × 1/32nd inch) if the arrangement is such that the extent of stretch does not exceed the band's original unstretched length by more than 50 percent, the proper opening tension is achieved. It should be borne in mind that the trick is to so gauge the biasing force exerted by the band that the glider will remain in its launching condition until its apogee and then open and not before. If it opens before the apogee, the glider's overall flight path is reduced and its effectiveness to the user is lessened. Therefore, it is important that the biasing force be sufficient to cause the glider to open at its apogee but not before. Note that the passage of air across the wing surfaces of the glider tends to hold the wings in their launching position, once moved to that position, so the biasing force of the rubber band is acting against the force of the air tending to hold the glider in its original launching condition.

Inasmuch as the glider shape and size can change, we have found that for a reasonable range of sizes, the biasing force should not exceed 90 grams, or else the force is too great and will cause opening prior to the apogee position.

In practice, we have discovered that the above relationship can be obtained with a standard band if, when the glider is in its launching position, the holes 37 at such time are spaced apart a distance approximately equal to the distance between a knob 33 and the associated hole 37. This gives a stretch of approximately 50 percent greater than the original unstretched length of the band. Preferably, the band is not totally unstretched in its flight condition but is only slightly stretched.

What is claimed is:

1. A toy aircraft having a fuselage comprising a pair of body halves hingedly connected together for movement from a launching position to a post launching flight position, each body half carrying an airfoil panel, and a launching hook on one body half which projects therefrom in the opposite direction from that of said airfoil panels and in an exposed position, when the halves are swung to the launching position.

2. A toy aircraft having a fuselage comprising a pair of body halves hingedly connected together for movement from a launching position to a post launching flight position, each body half carrying an airfoil panel, and a launching hook on one body half which projects therefrom when the halves are swung to the launching position, said hook being accommodated within a recess in the other body half when the halves are in their post launching flight position.

3. An aircraft as recited in claim 1 wherein the body halves are essentially flat elongated members and wherein said hook is an integral extension of said one body half projecting from the plane thereof.

4. An aircraft as recited in claim 1, 2 or 3 wherein the hook is so formed as to be disposed in the plane of the airfoil panel of said other body half in the flight position of said body halves.

5. A toy aircraft as recited in claim 3 wherein said hook is disposed at right angles to the plane of said one body half.

6. A toy aircraft as recited in claim 1 in which the airfoil panels are interconnected by a rubber band tending to move the body halves to their flight position.

7. A toy aircraft as recited in claim 6 in which the rubber band is stretched, when the body halves are tilted from the flight position to the launching position, by an amount equal to approximately one-half the length of the band when the body halves are in their flight position.

8. A toy aircraft as recited in claim 7 in which the operative angle of the rubber band when the body halves are in their launching position exceeds the toggle or overcenter angle only a few degrees.

9. A toy aircraft as recited in claim 6 in which the biasing force exerted by the rubber band when the aircraft is in its launching position does not exceed 90 grams.

10. A toy aircraft as recited in claim 6 in which the biasing force exerted by the rubber band is less than the force created by air rushing past the wings that tends to cause the aircraft to remain in its launching position, so as to avoid premature opening movement of the wings to flight position.

* * * * *